United States Patent [19]

Ohmae

[11] 4,139,673

[45] Feb. 13, 1979

[54] SURFACE-COATED BLAST FURNACE TUYERE MADE OF COPPER OR COPPER ALLOY AND METHOD OF SURFACE-COATING THE SAME

[75] Inventor: Yutaka Ohmae, Shiga, Japan

[73] Assignee: Nihon Karoraizu Kogyo Kabushiki Kaisha, Osaka, Japan

[21] Appl. No.: 825,085

[22] Filed: Aug. 16, 1977

[30] Foreign Application Priority Data

Feb. 22, 1977 [JP] Japan ..... 52-19034

[51] Int. Cl.[2] ..... B32B 15/20; B32B 15/18

[52] U.S. Cl. ..... 428/336; 427/376 B; 427/376 C; 427/383 D; 428/472; 428/539

[58] Field of Search ..... 427/383 D, 376 B, 376 C; 428/472, 457, 539, 336

[56] References Cited

U.S. PATENT DOCUMENTS

| | | | |
|---|---|---|---|
| 2,988,807 | 6/1961 | Boggs | 427/383 D |
| 3,340,026 | 9/1967 | Kiwak | 427/376 B |
| 3,415,631 | 12/1968 | Ault et al. | 428/472 X |
| 3,564,565 | 2/1971 | Haberecht et al. | 427/383 D |
| 3,891,784 | 6/1975 | Allardyce et al. | 427/383 D |

FOREIGN PATENT DOCUMENTS

| | | | |
|---|---|---|---|
| 27056 | 8/1973 | Japan | 427/383 D |

*Primary Examiner*—Harold Ansher
*Attorney, Agent, or Firm*—Spensley, Horn & Lubitz

[57] ABSTRACT

The invention relates to a surface-coated blast furnace tuyere made of copper or copper alloy capable of sufficiently resisting heat attack and abrasion attack caused by the splashing of molten metal and slag. The invention also relates to a method of surface-coating the tuyere with advantages both in process steps and in economy.

12 Claims, 4 Drawing Figures

SURFACE-COATED BLAST FURNACE TUYERE MADE OF COPPER OR COPPER ALLOY AND METHOD OF SURFACE-COATING THE SAME

BACKGROUND OF THE INVENTION

1. Field of the Invention

This invention relates generally to a heat-resisting and abrasion-resisting tuyere for a blast furnace made of copper or copper alloy and a method of surface-coating the same, and more particularly, to a blast furnace tuyere made of copper or a copper alloy with a specific coated layer thereover capable of sufficiently resisting heat and abrasion attacks caused by the splashing of molten metal and slag. The invention is also concerned with a method of surface-coating the tuyere with advantages both in process and in economy.

2. Prior Art

Prior to this invention, the present applicant has made a copending application for an invention regarding a heat resisting copper or a copper alloy product having a specific surface-coated layer thereon by which marked improvements were made in high temperature oxidation resistance, corrosion resistance, abrasion resistance and thermal shock resistance. This prior invention was also directed to a method of surface-coating the product. This prior invention was made public with Japanese patent publication No. 105739-1974 (patent application Ser. No. 17649/1973) which is herein incorporated by reference.

In this invention, the aforesaid specific surface-coated layer includes metallic oxide powders of high melting point such as $Al_2O_3$, $ZrO_2$, $TiO_2$, $Cr_2O_3$, etc. and a fused Al layer which is carried in or carried in and simultaneously absorbed into and embraced by the oxide powders and the base metal present directly below the coated layer formed of a diffusion-penetration layer of Al-Fe. With the layer construction as above, the copper or copper alloy product is increased in its heat, abrasion and other resisting properties thus adapting it for use with various members such as the wall, nozzle, etc., in a blast furnace, converter furnace and the like.

Since the contents of the previous invention have been disclosed in the Japanese patent publication, more detailed explanation of the previous invention other than the above is omitted herein. A description will now be given of the reasons that have made it necessary to make the improvements as set forth in the previous invention.

(a) Heat resistance and abrasion resistance strongly demanded of the tuyere in the furnace has made it insufficient to have recourse exclusively to the coating means provided by the previous invention and has necessitated further increases in both properties. One means conceivable for this purpose by those skilled in the art is to increase the concentration of Al of the constituent parts of Al in the coated layer. Too great a concentration (for example, 40%), however, of Al in the coated layer causes thinning and cracking in the surface of the diffusion-penetration layer. This makes it impossible to attain the expected advantages due to an increase in concentration. In order to prevent such thinning and cracking, there is no alternative but to limit an Al content up to at most, approximately 28% (by weight). Even in this case, the hardness necessary for the surface of the tuyere cannot be obtained. Herein lies one stumbling block to which the problem of increasing the concentration of Al of coated layer is always brought.

On the other hand, when Al powder alone is used as was the case with the previous invention, there are two modes of diffusion-penetration by Al powder; one mode being that the Al powder itself is fused to the surface of the base metal and makes contact diffusion from the fused surface, and the other mode being that of vaporizing Al so as to diffuse through the base metal. Despite the fact that the latter method produces a product which is originally stronger than that produced by the former method in diffusion effect, the latter method is less effective in causing diffusion through the base metal under the conditions for treatment according to the previous invention. Therefore, sufficient treatment cannot be expected from a diffusion-penetration mechanism based exclusively on the Al powder. Prolongation of the time for treatment to improve this as much as possible results in disadvantages in the treatment cycle. Even if the increase of quantity of diffusion of Al should prove successful, for example, when the quantity of Al becomes 30% (by weight), an undesirable effect of thinning and cracking is likewise produced on the surface of the base metal. In this manner, the advantages of the previous invention still leaves a difficult problem that cannot be solved either by using various coating material compositions or by treatment conditions.

SUMMARY OF THE INVENTION (a) In view of the problems described above, the present inventor has made various studies and experiments in conjunction with the problems and has successfully solved the problems by:

(i) forming an Al diffusion-penetration layer free from thinning and cracking described above by using Al powder in smaller quantities than in the prior art, using Fe-Al alloy powder in compensation for the amount of Al powder reduced by using ammonium halide, such as $NH_4Cl$, in the form of a catalyzer capable of dissociating active Al and active Fe effective for diffusion from the alloy powder, and also by (ii) simultaneously diffusing Fe through the Al diffusion-penetration layer to positively form a three-alloy layer of Cu-Al-Fe in the coated layer.

The hardness of the surface of the tuyere that has been subjected to the treatment of the invention is 1.6 to 1.8 times as high as that of the previous invention. According to this invention, the coated layer comprises a sintered layer of the respective kinds of metallic oxides and a Al-Fe alloy and a Cu-Fe-Al alloy layer carried in the apertures between the particles of the kinds of powder or further absorbed into and embraced by the metallic oxide powder particles. It further includes a diffusion-penetration layer of Al and Fe under the coated layer, namely a Cu-Al-Fe alloy. Thus, it follows that new contact diffusion of Al-Fe by the Fe-Al alloy powder in the coated layer and the respective gas diffusions of Al gas and Fe gas to be dissociated from the Fe-Al alloy powder are added to the diffusion mechanism of the previous invention. Consequently, the high hardness surface layer mentioned above (at the same time, high-temperature resisting layer) is obtained.

(b) When it is necessary to provide higher resistance to pitting in conjunction with Item (a), such resistance is successfully increased by covering the coated layer with a ceramic heat-resistant layer consisting of $Al_2O_3$ and $SiO_2$.

(c) In the previous invention a coating material was subjected to pretreatment by being heated in a neutral atmosphere for several hours and thereafter a base metal was embedded in the coating material. The present invention can dispense with such pretreatment of the coating material which makes it possible to subject both the coating material and base metal to heat treatment at the same time.

The Items (a), (b) and (c) mentioned above constitute the outline and features of the present invention.

The novel features which are believed to be characteristic of this invention, both as to its organization and method of operation, together with the further objectives and advantages thereof, will be better understood from the following description considered in connection with accompanying drawings in which a presently preferred embodiment of the invention is illustrated by way of example. It is to be expressly understood, however, that the drawings are for the purpose of illustration and description only and not intended as a definition of the limits of the invention.

DETAILED DESCRIPTION OF THE INVENTION

Figure 3:
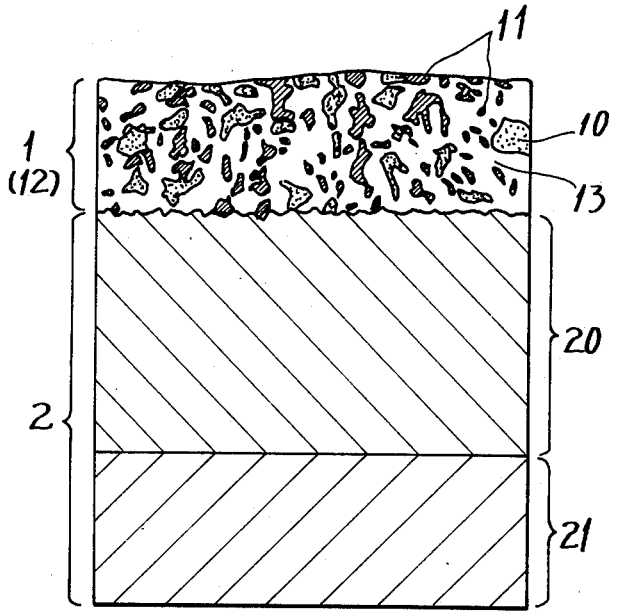
FIG. 3 is a microscopic texture simulation view of the material used in the tuyere of the invention.

The invention will now be described in detail. The blast furnace tuyere of the invention, as shown by a microscopic sectional simulation view of the texture of the material of the tuyere in FIG. 3, is made of a coated layer 1 and a base metal 2 of copper or a copper alloy. The coated layer 1 includes a mixed sintered layer 12 of $Al_2O_3$, $ZrO_2$ and other dystectic point metallic oxide powder 10, Fe-Al alloy powder 11, and a Cu-Fe-Al alloy layer 13 which is either carried in the sintered layer 12 or absorbed into and embraced by the metallic oxide powder 10.

Figure 1:
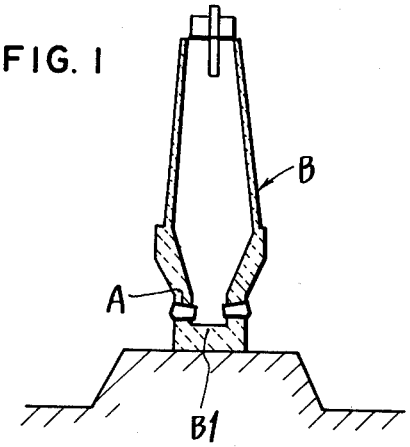
FIG. 1 is a schematic sectional view of a blast furnace including the tuyere of the invention.
Figure 2:
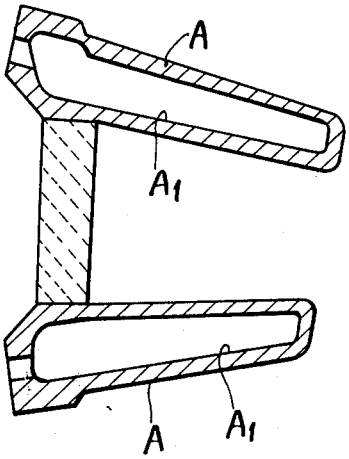
FIG. 2 is an enlarged sectional view of the tuyere portion of the invention.

The base metal 2 is directly below the coated layer 1 and has its surface formed of a diffusion-penetration layer 20 of Al and Fe and has a Cu or a Cu alloy foundation 21 formed directly below the diffusion-penetration layer 20. The tuyere shown in FIG. 1 is shown as being a usual tuyere A located in the neighborhood of the base portion of a blast furnace B. A more particular example of a usual tuyere is one designed to pass air blast therethrough and is made of copper or a copper alloy having inside a jacket $A_1$ (See FIG. 2) adapted to circulate cooling water therethrough. Needless to explain, a base portion $B_1$ directly below the tuyere A constitutes a basin for molten iron and is attacked by constant splash of both the molten iron (not shown) collected therein and slag (not shown) afloat on the surface of the molten iron. Hence, it is demanded that the tuyere has the heat resistance to a temperature of higher than 1600° C. and has the property of producing no pit due to the splash of the molten iron and the slag. The present invention provides a tuyere that can sufficiently meet such demand.

A coating method of obtaining a tuyere of the structure described above is characterized in that a tuyere made of copper or a copper alloy is embedded in a coating material made of a mixture of 25 to 35 parts by weight, which shall apply hereinafter, of one or more kinds of dystectic point metallic oxide such as $Al_2O_3$, $ZrO_2$, $TiO_2$, $Cr_2O_3$, $SiO_2$, $ThO_2$, MgO, etc., 2 to 5 parts of metallic Al powder, 60 to 72 parts of Fe-Al alloy powder and 0.3 to 0.5 parts of an ammonium halide. The coating material having the tuyere thus embedded therein is maintained at a temperature of 700° to 950° C. in a neutral atmosphere for several hours, to thereby sinter the coating material onto the surface of the tuyere. The tuyere is then coated with the material to diffuse and penetrate the Al and Fe constituents in the coated layer from the surface to the inside of the tuyere.

This coating method will now be described in detail with reference to the structure of the coated layer. The coating material consists of a mixture of 25 to 35 parts of dystectic point metallic oxide of 100 to 250 mesh, 2 to 5 parts of metallic al powder of 80 to 100 mesh, 60 to 72 parts of Fe-Al alloy powder of 80 to 100 mesh, and 0.3 to 0.5 parts of an ammonium halide (typically, $NH_4Cl$). A tuyere made of copper or a copper alloy which is to be treated is embedded in the coating and is maintained in a neutral atmosphere such as argon gas, at a temperature in the range of 700° to 950° C. for several hours. This surface treatment of the structure is shown in FIG. 3. In the treatment above, a Fe-Al alloy is used in a ratio of 50 to 30% by weight of Fe to 50 to 70% of Al. When the coating material contains less than 50% of Al, the material becomes greater in Fe content in the repeated use of the tuyere. When the coating material contains more than 70% of Al and when Fe-Al powder is sintered to the surface of the base metal, a tendency of "thinning" takes place on the surface portion to which the Fe-Al powder is thus sintered. Preferably, the coating material contains about 52% of Al and about 48% of Fe. Reasons for using 2 to 5 parts of Al powder and 60 to 72 parts of Fe-Al powder will be mentioned below. The essential reason for using Al powder is that since Al powder is quicker than Fe-Al powder in vaporing or depositing on the material to be treated, the amount of Al that is deposited from the Fe-Al alloy powder is not sufficient for the intended treatment. It therefore becomes necessary to place Al on the material to be treated in preparation for the Al shortage due to the Fe-Al alloy:

(1) When the Al powder is below the limited range and the Fe-Al powder exceeds the limited range, vaporizing and depositing of Al from the Al powder in the coating material in the initial stage of treatment tends to be small so that recourse must be had to depositing of Al from the Fe-Al powder. If the depositing of Al from the Fe-Al powder is effected, depositing of Fe from the Fe-Al powder is also effected at the same time, thus both Al and Fe diffuse and penetrate through the material to be treated to that an Al alloy layer of sufficient concentration cannot be obtained.

(2) In contrast thereto, when the Al powder is below the limited range and the Fe-Al powder is below the limited range, the concentration of Al is reduced in a greater degree than that in the case of Item 1.

(3) When the Al powder exceeds the upper limit, there are produced the following results regardless of whether the Fe-Al powder is in the upper or in the lower limit.

If the Fe-Al powder is below the lower limit, when the Al powder exceeds the upper limit, a larger quantity of the Al powder than the quantity of Al powder used in the diffusion-penetration remains in the coated layer.

This constitutes a cause of cracks in a film to be formed. Conversely, when the Fe-Al powder exceeds the upper limit, it causes thinning.

In view of the facts described above, the range of 2 to 5 parts of Al powder indicates a range within which the physical or chemical reaction from the Al powder is completely ended before a reaction such as depositing and fusing of Al and Fe from the Fe-Al powder to the material to be treated is effected or while the reaction is being effected. A reaction mechanism in which heat treatment is effected by use of the above coating material is as follows:

(a) Metallic Al Powder. The powder begins melting at its melting point of 660° C., and comes in contact with and fusedly sticks to the surface of the base metal. It also causes melting and penetrates through the base metal below the powder. Part of the Al powder is gassified as melting of the Al powder progresses and gas diffusion by the Al gas is carried out. Although the contact of this Al powder and diffusion by the following Fe-Al alloy powder, the amount of Al powder used in the invention is suppressed to a smaller amount than in the previous invention for the reasons already mentioned so as to prevent the thinning and cracks from being produced on the surface of the diffusion-penetration layer.s is carried out. Although the contact of this Al powder and diffusion by the following Fe-Al alloy powder, the amount of Al powder used in the invention is suppressed to a smaller amount than in the previous invention for the reasons already mentioned so as to prevent the thinning and cracks from being produced on the surface of the diffusion-penetration layer.

(b) Fe-Al alloy powder and ammonium halide. When $NH_4Cl$ is used as the ammonium halide, first the $NH_4Cl$ causes thermal dissociation at a temperature of about 400° C. and forms:

$$NH_4Cl \rightleftharpoons NH_3 + NCl \quad (I)$$

and HCl reacts with Fe-Al powder into $$\text{Fe—Al} + 2HCl \rightarrow \left.\begin{matrix} FeCl_2 + H_2 \\ AlCl_2 + H_2 \end{matrix}\right\} \quad (II)$$

$FeCl_2$ and $AlCl_2$ gasses respectively make diffusion-penetration into the base metal. But this gas diffusion is slower than the contact diffusion-penetration of the solid material. On the other hand, some of the $FeCl_2$ and $AlCl_2$ produced in Equation (II) reacts again with HCl into:

$$\left.\begin{matrix} FeCl_2 + H_2 \rightarrow Fe + 2HCl \\ AlCl_2 + H_2 \rightarrow Al + 2HCl \end{matrix}\right\} \quad (III)$$

The active Fe and Al are strong in diffusion-penetration into the base metal. Therefore, the production of the active Fe and Al molecule contributes toward an increase of the concentration of Al and Fe in the diffusion-penetration layer very effectively together with the contact and gas diffusion of Al powder. Some of the Fe-Al powder also is sintered and sticks to the surface of the base metal because of production of molten Al from the Al powder and makes diffusion-penetration by contact. The above various forms of diffusion-penetration based on the existance of Fe-Al powder is slower than the diffusion-penetration of Al powder, but the former increases the concentration of Al and Fe in the diffusion-penetration layer step by step along with progress in the treatment of the base metal. In addition it does not cause thinning and crack on the surface of the diffusion-penetration layer while the treatment is progressing. The behavior of the Al powder and Fe-Al powder in the coating material is such that the Cu in the base metal moves to the surface side in response to the diffusion-penetration of Al and Fe, and forms a Cu-Fe-Al alloy layer between the molten Al and the solid Fe-Al alloy powder. The alloy layer is either carried between the particles of the metallic oxide powder and the particles of Fe-Al alloy powder, or further absorbed into and embraced by the metallic oxide powder.

(c) Metallic Oxide Powder This powder has a high melting point, and therefore is not melted in the treatment cycle. Rather, it is sintered and sticks to the surface of the base metal. But the powder does not take place in any chemical reaction, instead it functions as a mere heat-resisting aggregate, and particles of the powder are connected by molten Al to each other. The thickness of the coated layer is, at least, 100μ, and preferably more than 500 to 800μ. The thickness of diffusion-penetration layer is greater than 1000μ, and preferably more than 1500μ. The composition of alloy in the coated layer is Cu, Fe and Al in the decreasing order of content. In the diffusion-penetration layer the composition of alloy is Cu, Al and Fe in decreasing order of content.

As the layer structural mechanism of the layer treated by the invention will have become apparent from the description above, it is desired that for further detail of the mechanism reference is made to a microscopic texture simulation view in FIG. 3. Preferred embodiments of the invention and test results will follow.

EXAMPLE 1

(A) Preparation of coating material:
Metallic Al powder (60 mesh): 2 parts
Fe-Al powder (30 mesh): 72 parts
$Al_2O_3$ powder: 25.5 parts
$NH_4Cl$: 0.5 parts (B) Coating method A Cu alloy test piece was embedded in the coating material in (A) and heat treated at 850° C. for 10 hours, to obtain a coating material having a coated layer 450μ in thickness and a diffusion-penetration layer 800μ in thickness.

EXAMPLE 2

(A) Preparation of coating material
Metallic Al powder (60 mesh) 3 parts
Fe-Al powder (finer than 30 mesh) 70 parts
$ZrO_2$ powder 26.5 parts
$NH_4Cl$ 0.5 parts (B) Coating method A Cu alloy test piece was embedded in the coating material in (A) and heat treated at 880° C. for 12 hours, to obtain a coating material having a coated layer 600μ in thickness and a diffusion-penetration layer 1600μ in thickness.

EXAMPLE 3

(A) Preparation of coating material
Metallic Al powder (60 to 80 mesh): 2 parts
Fe-Al powder (finer than 50 mesh): 60 parts
$Al_2O_3$: 37.5 parts
$NH_4Cl$: 0.5 parts
(B) Coating method
A Cu alloy test piece was embedded in the coating material in (A) and heat treated at 880° C. for 12 hours, to obtain a coating material having a coated layer 450μ in thickness and a diffusion-penetration layer 1450μ in thickness.

EXAMPLE 4

(A) Preparation of coating material
Metallic Al powder (60 to 80 mesh): 5 parts
Fe-Al powder (finer than 50 mesh): 68 parts
$Al_2O_3$: 26.5 parts
$NH_4Cl$: 0.5 parts
(B) Coating method
A Cu alloy test piece was embedded in the coating material in (A) and heat treated at 880° C. for 12 hours, to obtain a coating material having a coated layer 700μ in thickness and a diffusion-penetration layer 1800μ in thickness.

EXAMPLE 5

(A) Preparation of coating material
Metallic Al powder (60 to 80 mesh): 2 parts
Fe-Al powder (finer than 50 mesh): 72 parts
$SiO_2$: 25.5 parts
$NH_4Cl$: 0.5 parts
(B) Coating method
A Cu alloy test piece was embedded in the coating material in (A) and heat treated at 880° C. for 12 hours, to obtain a coating material having a coated layer 600μ in thickness and a diffusion-penetration layer 1600μ in thickness.

As a result of the experiments, if the temperature conditions for treatment are the same, a coating material containing a large quantity of Fe-Al powder shows a tendency for the coated layer to become thicker.

TEST RESULTS

Figure 4:
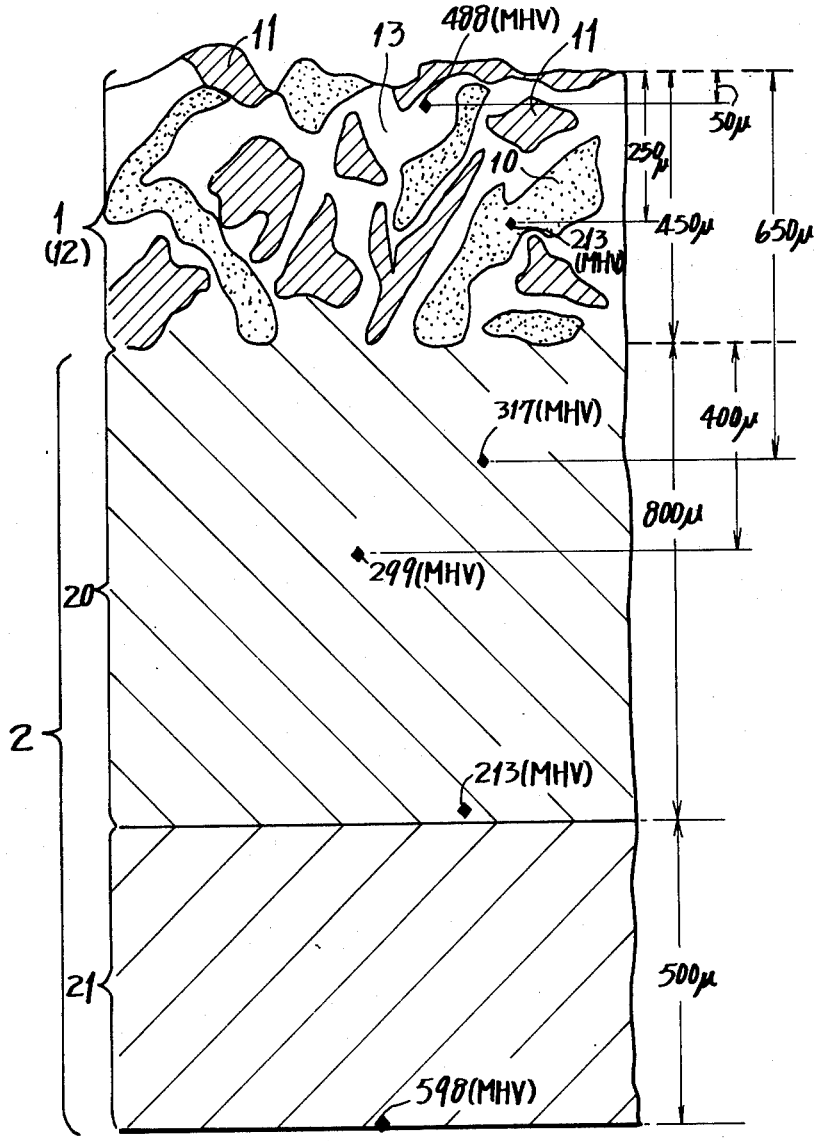
FIG. 4 is a diagram illustrating hardness test point (in Example 1) concerning the diffusion-penetration layer and base metal of FIG. 3.

The hardness value measured at any position of thickness by Vickers hardness tester (incidental load F is 100 g) concerning the coating material according to Example 1 of the above examples is shown in FIG. 4.

As apparent from FIG. 4, a Cu-Fe-Al alloy layer 13 near the surface of the coated layer 1 according to the invention shows a high hardness of 488 MHv. This hardness is 8 times as high as that of the base metal and is equivalent to 1.6 to 1.8 times as high as that of the surface hardness of the previous invention (280 to 300 MHv). The surface hardness in the diffusion-penetration layer 20 indicates about 300 MHv in the upper part and about 200 MHv even in the lower part, both values of which hardness are execellently high. Although that part of oxide powder 10 in the coated layer 1 is lower in hardness than the alloy layer 13, it has the hardness which equals the hardness of the lower part of the diffusion-penetration layer 20.

The resistance of the surface of the tuyere of the invention to high temperatures, abrasion and attack by molten metal slag is sufficiently adaptable to the surface of a tuyere for which a usual tuyere is used and to the property which is demanded from the tuyere. In particular, when the tuyere is placed in the severe conditions in which the tuyere is subject to heavy splash of slag and pitting by the slag which sticks to the tuyere, reinforcing of the tuyere surface can be attained by further coating the coated layer of the invention with a ceramic heat-resisting coated layer consisting of $Al_2O_3$ and $SiO_2$. This acts as a means of specially reinforcing the tuyere surface with its resistance to such pitting. $Al_2O_3$ and $SiO_2$ are mixed in a ratio of 10 to 65% (by weight) of $Al_2O_3$ to 90 to 35% of $SiO_2$, preferably 60 to 40% of $Al_2O_3$ to 40 to 60% of $SiO_2$. According to the coating method, an inorganic binding agent such as potassium silicate, sodium silicate, etc., is added to the above mixed powder of $Al_2O_3$ and $SiO_2$ to form it into a paste. The paste is applied to the tuyere surface to a thickness of 150 to 500μ by brushing or spraying, and dried. When the coating is less than 150μ in thickness, the effectiveness of coating is reduced and conversely when it is more than 500μ in thickness, such thick coating tends to constitute the reason why the coated layer of ceramics does not adhere well.

As will have become apparent from the description above, the tuyere of the invention is an excellent tuyere which has made it possible to form a coated layer of very high hardness over a copper or a copper alloy base metal for a tuyere. Improve abrasion resistance and corrosion resistance of the tuyere in high temperatures and increase the resistance of the tuyere to splash of molten metal and its slag is also achieved. The method of coating of the invention is also highly useful in that it does not need the two steps of production as was required by the previous invention, but only one step of production.

What I claim is:

1. A copper or copper alloy tuyere having Fe and Al diffused into the upper surface thereof thereby forming a diffusion-penetration layer, and a sintered layer disposed on diffusion penetration layer, said sintered layer formed from (i) a dystectic point metallic oxide powder, (ii) an Fe-Al alloy powder, and (iii) a Cu-Fe-Al alloy.

2. An alloy tuyere according to claim 1 wherein said diffusion-penetration layer and said sintered layer are formed by coating a surface of said tuyere with a mixture of (a) 25 to 35 parts of an oxide powder selected from the group consisting of $Al_2O_3$, $ZrO_2$, $TiO_2$, $Cr_2O_3$, $SiO_2$, $ThO_2$, and MgO;
(b) 2 to 5 parts of Al powder;
(c) 60 to 72 parts of Fe-Al alloy powder; and
(d) 0.3 to 0.5 parts of an ammonium halide, and maintaining said coated tuyere at a temperature of 700° to 950° C. in an inert atmosphere for a sufficient time to cause said sintered layer to be formed and to diffuse the Al component and Fe component of the said mixture into the surface of said tuyere.

3. An alloy tuyere according to claim 2 wherein said oxide powder is 100 to 250 mesh, said Al powder is 80 to 100 mesh and said Fe-Al alloy powder is 30 to 100 mesh.

4. A tuyere according to claim 3 wherein said sintered layer is at least 500 to 700μ in thickness.

5. A tuyere according to claim 3 wherein said diffusion-penetration layer is more than 1000μ in thickness.

6. A tuyere according to claim 3 wherein said Fe-Al alloy powder is 30 to 100 mesh, and said dystectic metallic oxide powder is selected from the group consisting of $Al_2O_3$, $ZrO_2$, $TiO_2$, $Cr_2O_3$, $SiO_2$, $ThO_2$, and MgO.

7. A tuyere according to claim 3 wherein said Cu-Fe-Al alloy is disposed in said sintered layer.

8. A tuyere according to claim 3 when said Cu-Fe-Al alloy is absorbed into said metallic oxide powder in said sintered layer.

9. A tuyere according to claim 3 wherein said tuyere is provided with a ceramic heat-resisting coated layer of $Al_2O_3$ and $SiO_2$.

10. A tuyere according to claim 9 wherein said ceramic heat-resistant layer is made of 40 to 60 weight percent $Al_2O_3$ and 60 to 40 weight percent $SiO_2$.

11. A method of surface-coating a copper or a copper alloy made tuyere for a blast furnace, said method being characterized by:

(a) coating said tuyere with a coating material, said coating material being made of 25 to 35 parts of a dystectic point metallic oxide powder selected from $Al_2O_3$, $ZrO_2$, $TiO_2$, $Cr_2O_3$, $SiO_2$, $ThO_2$, MgO,
2 to 5 parts of metallic Al powder,
60 to 72 parts of Fe-Al alloy powder,
0.3 to 0.5 parts of an ammonium halide; and (b) maintaining said coating material at a temperature in the range of 700° to 950° C. for several hours in an inert atmosphere further sintering said coating material to said tuyere surface so as to diffuse and penetrate the Al component and Fe component contained in said coating material beneath the surface of said tuyere.

12. A method of surface-coating according to claim 9 wherein said dystectic point metallic oxide powder is 100 to 250 mesh, said metallic Al powder is 80 to 100 mesh, and said Fe-A alloy powder is 30 to 100 mesh.

* * * * *